US012024840B2

(12) United States Patent
Nguyen Van

(10) Patent No.: US 12,024,840 B2
(45) Date of Patent: Jul. 2, 2024

(54) PROTECTIVE MODULAR BARRIER AGAINST WATER RUNOFF AND FLOODING

(71) Applicant: CUIRASSIER, Futuroscope (FR)

(72) Inventor: Luc Nguyen Van, Paris (FR)

(73) Assignee: CUIRASSIER, Futuroscope (FR)

( * ) Notice: Subject to any disclaimer, the term of this patent is extended or adjusted under 35 U.S.C. 154(b) by 208 days.

(21) Appl. No.: 17/640,122

(22) PCT Filed: Sep. 6, 2019

(86) PCT No.: PCT/IB2019/001042
§ 371 (c)(1),
(2) Date: Mar. 3, 2022

(87) PCT Pub. No.: WO2021/044181
PCT Pub. Date: Mar. 11, 2021

(65) Prior Publication Data
US 2022/0316164 A1 Oct. 6, 2022

(51) Int. Cl.
*E02B 3/10* (2006.01)
*E02B 3/06* (2006.01)
*E02B 3/16* (2006.01)

(52) U.S. Cl.
CPC ..... *E02B 3/104* (2013.01)

(58) Field of Classification Search
CPC ..... E02B 3/102; E02B 3/104
See application file for complete search history.

(56) References Cited

U.S. PATENT DOCUMENTS 2,598,389 A 5/1952 Jermar
5,993,113 A 11/1999 Darling
2016/0244927 A1* 8/2016 Adler ..... E02B 3/104
2017/0175352 A1* 6/2017 Farhadzadeh ..... E02B 3/06
2018/0028950 A1* 2/2018 Heilman ..... B01D 29/15

FOREIGN PATENT DOCUMENTS

| | | | |
|---|---|---|---|
| CN | 107604883 | A | 1/2018 |
| CN | 107 142 894 | B | 12/2018 |
| GB | 2 450 875 | A | 1/2009 |
| JP | 2015-101893 | A | 6/2015 |
| JP | 2015-158117 | A | 9/2015 |
| WO | 99/41459 | A1 | 8/1999 |
| WO | 2018/024969 | A1 | 2/2018 |

OTHER PUBLICATIONS

International Search Report and Written Opinion issued in related application PCT/IB2019/001042, May 8, 2020, 9 pages.
Office Action issued in related application JP 2022-515058, Aug. 7, 2023, with English language translation, 8 pages.

* cited by examiner

*Primary Examiner* — Frederick L Lagman
*Assistant Examiner* — Stacy N Lawson
(74) *Attorney, Agent, or Firm* — Faegre Drinker Biddle & Reath LLP

(57) ABSTRACT

A module for implementing a protective barrier against liquid runoff and/or flooding comprising a retention member adapted to retain a liquid body on a front area located at a front side of the protective barrier, one or more sensors adapted to acquire at least one information about the module or about the liquid body, a relief valve, the relief valve being adapted to be actuated from a closed state to an open state according to the information acquired and provided by the sensor, and related system and method.

16 Claims, 12 Drawing Sheets

PROTECTIVE MODULAR BARRIER AGAINST WATER RUNOFF AND FLOODING

CROSS REFERENCE TO RELATED APPLICATIONS

This application is the U.S. national phase of the International Patent Application No. PCT/IB2019/001042 filed Sep. 6, 2019, the entire content of which is incorporated herein by reference.

FIELD

The disclosure pertains to the field of protective barriers against water runoff and flooding.

BACKGROUND

Flooding may occur as an overflow of water from water bodies, such rivers, lakes, or oceans. In some conditions, the water happens to overtop or breaks levees, resulting in some of that water escaping its usual boundaries.

Surface runoff (also known as overland flow) may occur due to an accumulation of rainwater on saturated ground in an area flood. This might occur because soil is saturated to full capacity, because rain arrives more quickly than soil can absorb it, or because impervious areas (roofs and pavements) send their runoff to surrounding soil which cannot absorb all of it.

A barrier may be placed temporarily around a specific area to keep floodwaters or water runoff from entering an area to be protected.

Various systems exist for creating barriers to protect homes (or other buildings or grounds) against the risk of flooding, or water run-off, especially of water or sludge, or industrial liquid.

Advantageously, the barrier may be constituted of several modules. The modules can be conveyed separately and assembled to each other on site. This way, they make it possible to obtain a protective barrier against surface flows of water. Also, disassembly and stowing is made easier with these modular solutions compared to monolithic solutions.

Further, after the protective barrier is set up by assembling the several modules together, it is difficult to get information on the behaviour of the modules when facing the flood or the water runoff.

Such information may be crucial to know, advantageously in real-time, for controlling the operating conditions and general behaviour of the protective barrier.

For instance, if the water rises too quickly or if water pressure is too high, it may be necessary to anticipate other solutions to reinforce the protection of the area. In any case, mechanical integrity of the barrier must be preserved.

The present disclosure promotes improved solution(s).

SUMMARY

According to one aspect of the present disclosure, it is proposed a module (2) for implementing a protective barrier (1) against liquid runoff and/or flooding, the module comprising:

- a retention member adapted to retain a liquid body on a front area (A) located at a front side of the protective barrier,
- at least one sensor (6) adapted to acquire at least one information about the module or about the liquid body;

- at least one relief valve (10), the relief valve (10) being adapted to be actuated from a closed state to an open state according to the information acquired and provided by the sensor.

Thanks to this arrangement, it is possible to provide a smart protection arrangement, where the mechanical integrity of the protective barrier can be monitored and saved/safeguarded by opening one or more relief valve. In a situation where the mechanical integrity of the barrier is jeopardized, a discharge of some amount of water through a relief valve advantageously decreases the stress exerted by the retaining water on the barrier.

One understands that it is preferable to let some water go through instead of risking an advent of a sudden breakage of part or all of the protective barrier.

It is important to note that the decision of activating/opening a relief valve may be taken locally at the module or remotely at a server which receives information from various sensors/modules.

The opening of one or more relief valve along the protective barrier can also be performed even though the protective barrier is not jeopardized, but for purposes of regulating what overall downstream the protection installation.

In various embodiments, one may possibly have recourse in addition to one and/or other of the following arrangements, taken alone or in combination.

According to one aspect, the promoted module may be adapted to be assembled to other similar modules (2) to implement the protective barrier (1), the modules (2) being assembled to one another by an attachment device (5). Such attachment device can compensate for misalignments along the protective barrier, allowing to build a curved protective barrier, and to alleviate for a ground which is not flat.

According to one aspect, the sensor (6) and the relief valve (10) are mounted on the attachment device (5). Therefore, the basic module itself remains a very simple mechanical part. All the complexity is born by the attachment device. In practice the attachment device can bear the water-tightness function, the misalignment compensation of two neighbouring modules and finally the entity(ies) necessary for sensing the stress and/or other parameters and also the actuator to open a relief valve to discharge water.

According to one aspect, there is provided one or more sensors preferably arranged on a sensor module (60) removably inserted into the attachment device. The sensor module can be selectively installed as an option according to the operational needs/requirements. Also, with the sensor module, the sensor(s) can be serviced independently from the rest of the protection module.

According to one aspect, the module may comprise:

- a base (3) adapted to anchor or to weight the module (2) to the ground; and
- a wall (4) forming the retention member and extending substantially in a vertical direction from the base (3) and adapted to retain the liquid on the front side of the protective barrier. Whereby each of the base and the wall can be optimized for its own function, respectively for the base (i.e. housing water and provided a good contact with the ground), and further for the wall (i.e. efficiently retaining water). Base and wall can be attached to one another in a removable manner.

According to one aspect, the sensor (6) senses a height of the liquid body. The information about the liquid height retained by the module can be one essential parameter to trigger an opening of the relief valve.

According to one aspect, the sensor (6) senses an acceleration denoting a movement of the module. The information about a sliding of the module (or just the beginning of the sliding) can be one relevant parameter to trigger an opening of the relief valve to preserve/save the barrier.

According to one aspect, the module comprises geolocating means, such as a GPS sensor/receiver. Thereby, the position of each module can be accurately known, whatever the order in which the modules have been attached to each other. The accurate geolocation can be transmitted to neighbouring modules and/or to remote server(s). Thereby, from the remote server standpoint, the constitution of the protective barrier comprising a plurality of modules can be reconstructed from their respective specific geolocation.

According to one aspect, there are provided two relief valves, one arranged above the other. Therefore it is possible to tune the discharge of liquid retained by the module, by opening one or the other, or both, relief valves. For instance by opening the upper valve but not the lower valve, the discharge of liquid will concern only the upper portion of the retained liquid. By opening both valves the flow of the discharge is maximal.

The present disclosure is also directed to a system, the promoted system comprising a plurality of modules (2) as defined above; and one or more computer(s) (7, 15) connected to the sensor (6) of the modules (2), said computer being adapted to receive information from the sensor (6) and to output an actuation signal intended to open the relief valve (10) of one or more module (2).

Regarding the one or more computer, there is provided a local control unit (7), at the module level, configured to collect various parameters for a plurality of sensors, and additionally a remote server (15) configured to receive data collected by various sensors and local control units associated with the modules.

According to one aspect, there may be provided a local control unit (7), in charge of collecting values parameter from a plurality of local sensors; such local control unit can make local decision(s) according to basic decision-making rules about opening or closing the local relief valve.

According to one aspect, there may be provided additionally a remote server. Such remote server receives a large amount of data coming from most or all the retaining modules. The remote server can make decision based on a large amount of parameters. A simple or more complex strategy for opening or closing various relief valves can be worked out by the remote server and implemented by the local control units.

According to one aspect, the data delivered by the plurality of the sensors (6) of the modules is transmitted to the remote server via a low consumption wireless network, such as LoRa™ or SigFox™.

According to one aspect, the data delivered by the plurality of the sensors (6) of the modules is transmitted to the remote server via a short range wireless network, such as Bluetooth™ or Zigbee™.

According to one aspect, each module comprises geolocating means, where the current geolocation of each module is sent to the remote computer, and the remote computer is configured to aggregate the geolocation of each module with the information about the liquid body level and the acceleration data, and is configured to build therefrom a comprehensive image of the current state of the protective barrier. A compressive map display may be provided to a human manager in charge of monitoring the overall behaviour of the protective barrier.

The present disclosure is also directed to a method, the promoted method being defined by a method for controlling a protective barrier (1) comprising a plurality of modules (2) as defined above, advantageously in real time comprising at least the steps of:

acquiring information on the protective barrier (1) or on the retained liquid with one or more sensor (6);

processing the information to determine whether the protective barrier (1) may break due to the liquid pressure, make a decision to open one or more relief valve, make a decision to close one or more relief valve.

It should be understood that the above-mentioned decision can be taken by a human individual in charge of managing the behavior of the protective barrier, or alternatively or additionally the decision can be taken by a computer following predefined rules.

According to one aspect, each module comprises geolocating means, where the current geolocation of each module is sent to the remote computer, and the method further comprises:

send the current geolocation of each module to a remote computer, together with the information about the liquid body level and the acceleration data, aggregate the geolocation of each module with the information about the liquid body level and the acceleration data, build therefrom at the remote computer a comprehensive image of the current state of the protective barrier.

Thanks to such geo-located "picture", the relevance of the decision can be enhanced, and the place(s) where the relief valve should open can be more effective, for safeguarding the protective barrier and/or for managing liquid flow downstream and along the barrier.

According to one aspect, the actuation signal to open the relief valve is issued whenever a height of the liquid body exceeds a first predetermined threshold (HL), or an acceleration experienced at the module exceeds a second predetermined threshold (AL). This represents an example of stress limit that can be withstood by the protective barrier.

BRIEF DESCRIPTION OF THE DRAWINGS

Other features and advantages of the disclosure appear from the following detailed description of some of its embodiments, given by way of non-limiting example, and with reference to the accompanying drawings, in which:

FIG. 13 shows a stowed configuration, FIGS. 14 and 15 show a working configuration.

DETAILED DESCRIPTION

In the figures, the same references denote identical or similar elements, unless stated otherwise. For sake of clarity, some elements may be represented intentionally not at scale.

System Overview and Module

Figure 1:
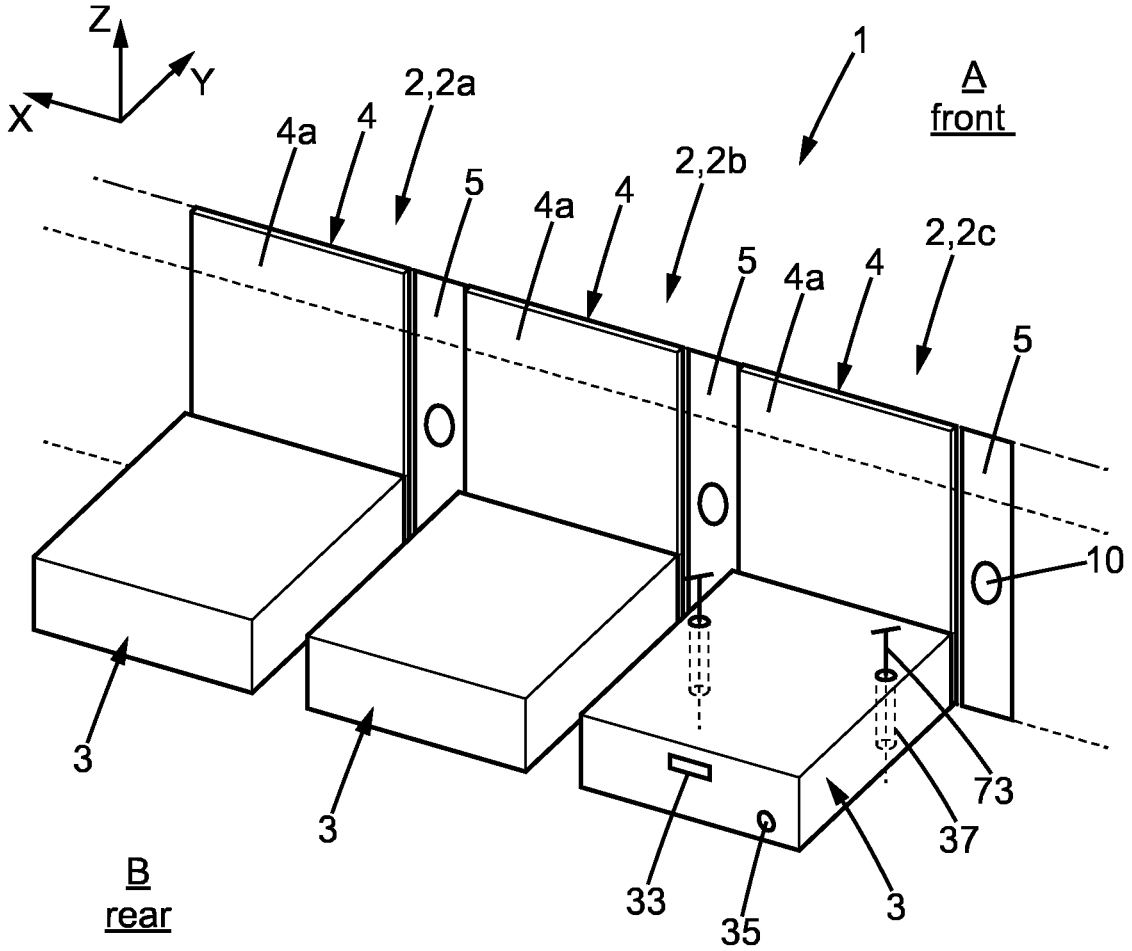
FIG. 1 shows a schematic rear perspective view of a protective barrier comprising several modules according to an embodiment of the present disclosure.

It is now referred to FIG. 1 which illustrates a protective barrier 1.

The protective barrier 1 is adapted to retain a non-gaseous liquid so as to prevent any runoff or flooding on one side of the protective barrier 1.

By "non gaseous liquid", it is understood essentially liquid, more or less viscous fluids, such as water, sludge, or industrial liquid, referred to as liquids hereafter.

The protective barrier 1 can be used in a wide variety of situations, to protect a specific area, a building and the like.

The protective barrier 1 can be advantageously installed temporarily, in emergency cases.

The protective barrier 1 can be installed according to different configurations which may depend on its specific use.

FIG. 1 describes a partial perspective view of the protective barrier 1 that extends along a main direction X, to prevent liquid located or arriving in a front zone denoted A from entering in a rear zone denoted B located on the opposite side of the protective barrier 1.

A transversal direction Y is also defined that is perpendicular to the main direction X. Liquid pressure is mainly exerted along transverse axis Y. Said otherwise, protective barrier 1 along axis X delimits zone A from zone B.

The ground on which the protective barrier 1 is installed extends substantially in parallel to a plane comprising both main and transversal directions X, Y.

Other configurations are possible, such as a curved or loop implementation of the protective barrier 1 to allow channeling or temporary storing liquid. Ground may not be plane.

Therefore there is provided two or more degrees of freedom in the module assembly to follow the ground and the desired overall shape of the protective barrier.

The protective barrier 1 comprises a plurality of modules 2. The modules 2 are independent from one another but can be assembled together to form the protective barrier.

Generally speaking, it is preferred that the module has a size and a weight compatible to be handled by a single person. Practically, the weight of the module 2 (in a state void of water) is less than 30 kg, preferably less than 25 kg, more details will be given below.

Each module 2 comprises at least a base 3 and wall 4.

In the following in the present document, the wall 4 is also called "retention plate" or "retention member" 4. Similarly, the base 3 is also called "box" 3 in the present document.

The base 3 is adapted to anchor or weight the module 2 to the ground, so that the module 2 can be held in place even when liquid is applying pressure on the front side of the module 2.

According to an embodiment, the base 3 can be a liquid-filled holding tank/box that extends in the plane XY. The surface of the base 3 that is in contact with the ground can also have a high friction coefficient (or a specific claws arrangement) so as to avoid or limit any movement of the module 2 during use.

According to another embodiment, the base 3 is anchored to the ground, by using any anchoring means, such as posts, screws, or the like.

The base 3 can be parallelepiped, with a rectangular or square basis, but any other shape is possible.

In the illustrated example, the base is formed as a box with a floor 30, a front wall 3*a*, a rear wall 3*b*, a right wall 3*c*, a left wall 3*d*. In the illustrated example, there are provided, at the exterior sides of the wall, one or more recess 33, that serves as a gripping means for handling the box by staff. In the illustrated example, there is provided a drainage plug 35 at the bottom of the back wall 3*b*.

The wall 4 is attached to the base 3 and is adapted to retain the liquid on the front side of the protective barrier 1, illustrated by zone A on FIG. 1. The attachment is preferably a removable attachment configuration as will be detailed later on.

The wall 4 extends substantially from the base 3 in a vertical direction Z. Also, the wall 4 comprises two opposite faces 4*a*, 4*b* of generally rectangular shapes. As illustrated on FIG. 2, one face 4*b* is adapted to come into contact with the liquid that is located in front zone A. The opposite face 4*a* is located towards rear zone B, also called dry zone.

The wall 4 can have a height H4 comprised between 60 cm and 120 cm preferably higher than 70 cm, and more preferably about 80 cm. More generally, the wall 4 has a height that is sufficient enough to prevent any ingress of liquid coming from over the protective barrier 1.

Advantageously a somewhat 80 cm height can retain a large amount of water and still people can walk or jump across the barrier; therefore even though such a barrier is installed, it does not preclude people from passing in case it is necessary, people safety is thus not jeopardized.

Each module can be manufactured in strong plastic material such as HDPE (High Density PolyEthylene). Further, each module can be manufactured in PVC, PP, ABS, or any equivalent sturdy and cost-effective plastic material.

The wall and the base can be manufactured separately, or as a single piece as an alternative. The part(s) can be obtained by moulding or roto-moulding.

Regarding the base 3, the weight of the base is preferably less than 25 kg, more preferably less than 20 kg.

Regarding the wall 4, the weight of the wall is preferably less than 8 kg more preferably less than 5 kg.

As a result there is no need to use a crane or hoisting means when a team of operators install or uninstall such modular protective barrier.

Regarding overall dimensions, H4 denotes the height of the wall 4 (retention plate) in its working position, H3 denotes the height of the box 3 along vertical axis Z, L4 denotes the width of the wall 4 along X, L3 denotes the width of the box 3 along X. E4 denotes the thickness of the wall 4. D3 denotes the depth of the box 3 along Y.

Each module 2 (except for the end modules of the protective barrier 1; not illustrated) can be assembled to two other directly adjacent modules 2, in a liquid-tight manner.

By "assembled in a liquid-tight manner", it is to be understood that no liquid can flow through the junction between two modules.

FIG. 1 describes an embodiment in which one module 2*b* is assembled to two other modules 2*a*, 2*c* on opposite sides. The assembled modules 2*a*, 2*b*, 2*c*, with other modules (not illustrated), form the protective barrier 1 that extends according to the main direction X.

To allow assembling two modules 2 with each other, each module 2 can comprise at least one lateral attachment device 5.

Even though it is preferred that the mechanical interface between two modules rely on such attachment device, it is not excluded to envision a solution where two modules are attached directly to one another.

The lateral attachment device 5 may be a flexible, rigid or articulated element. It may comprise flexible portion(s), bending portion(s), for level portion(s). The lateral attachment device 5 can be made of plastics.

In one embodiment the attachment device is flexible and allows a different angular position according to axis Y between the two contiguous modules.

In one embodiment the attachment device is flexible and allows a different angular position according to axis Z between the two contiguous modules.

Regarding the case where the ground is not even, the base is preferably fitted with a sealing joint 27 extending along the X-axis border.

The lateral attachment device 5 is of generally rectangular shape whose length in the vertical direction Z corresponds to the height of the wall 4.

Regarding overall dimensions, H5 denotes the height of attachment device 5 in its working position, L5 denotes the width of the attachment device 5 along X. E5 denotes the thickness of the attachment device 5 along Y.

The lateral attachment device 5 is generally made in a flexible material so it can be deformed to adapt to some slight or substantial non alignment between two consecutive modules. Non-alignment between two consecutive modules can be due to the ground being not flat, or can be due to the desired path of the protective barrier, which in some cases is not straight, but curved or even may include right angle turns. Non-alignment between two consecutive modules can also be due to inaccurate positioning of modules during installation.

Non-alignment between two consecutive modules can be either an angular difference around axis Z, an angular difference around axis Y. An angular difference around axis X can also be considered (twist along X); slight translational offsets can also be considered as well.

The sides of the lateral attachment device 5 comprise fastening means to be assembled to the walls 4 of two adjacent modules 2. To this end, the lateral attachment device 5 can be brought in interlocking connection with the walls 4 of the adjacent modules 2.

The mechanical interface between the lateral attachment device 5 and the retaining wall can be of several types. There may be provided a slider arrangement.

There may be provided grooves 51 along Z in one of the part, with complementary protrusions/beads 52 in the counterpart.

There may be provided a dovetail section in either the attachment device or the wall 4.

Installation of a lateral attachment device 5 in the retaining wall can be made by a sliding along vertical direction Z.

There may be provided pins in the lateral attachment device 5, such pins are configured to enter into corresponding through holes provided in the retention wall.

The pins may be mushroom type, with a head larger that the rod.

There may be provided a secondary locking device, as a slider which locks the heads of the mushroom type lugs.

Any type of tight and lockable interface can be considered for engaging/interfacing the lateral attachment device 5 with the retaining wall 4.

The lateral attachment device 5 has also a sealing joint 28 extending along the X-axis border. The sealing joint 28 is flexible enough to compensate for irregularities of the ground in the working position.

When being linked together by the lateral attachment device 5, the module 2 forms the protective barrier 1 that prevents any ingress of liquid from zone A to zone B.

A sealing joint 27 is arranged at the base of the wall 4. Alternatively the sealing joint 27 is arranged at the base of the box. Each of this sealing joint 27 is followed along longitudinal axis X by another already mentioned sealing joint 28 provided at the lateral attachment device 5.

Several sealing joints 27,28 are arranged one after the other along the longitudinal axis X such as they form together a continuous seal along the longitudinal axis X.

Sensor(s)

The protective barrier 1 also comprises at least one or several sensors 6. Sensors 6 can be useful to obtain information in real-time on the behaviour of the protective barrier 1 or on the properties of the retained liquid.

By "in real time", it is to be understood instantly or almost instantly, and at least during the use of the protective barrier 1.

Figure 9:
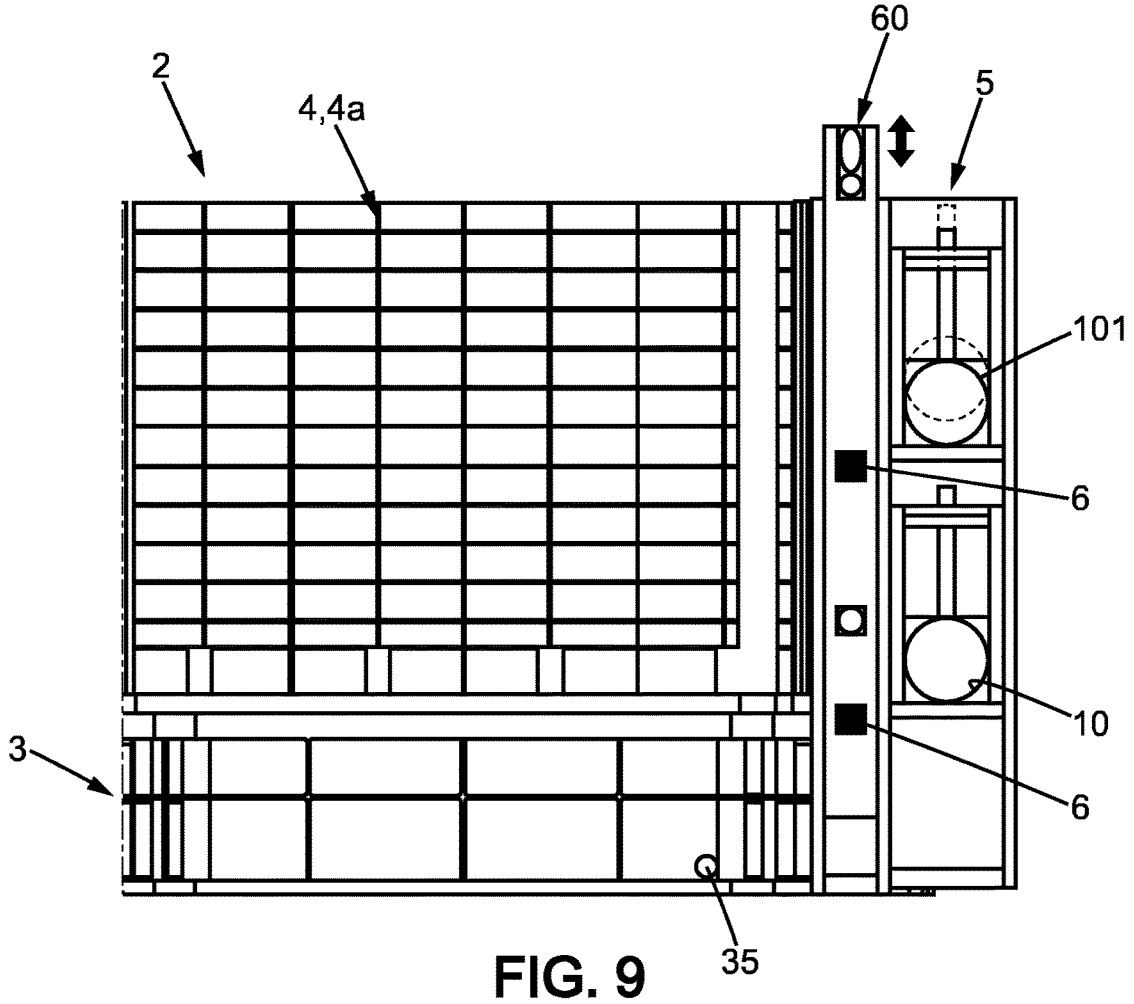
FIG. 9 shows a rear view of a module, in one embodiment with relief valves and sensor module.

As illustrated at FIG. 9, sensor(s) may be arranged in a specific sensor module 60. Sensor module can also be called sensor stick/sensor rod/sensor sub-assembly.

We note here that the sensor assembly is not necessarily present on every attachment device 5 or on every module 2.

According to preferred configuration, sensor module 60 can be housed in the attachment device 5. However sensor module could also be housed elsewhere in the module 2.

A sensor 6 can be adapted to measure different information.

According to an embodiment, the sensor 6 is adapted to measure a movement of the module 2.

By "measure a movement", it is to be understood that the sensor 6 can measure acceleration or velocity of the displacement of the module 2.

Such movement of the module 2 can occur along the main direction X, the transversal direction Y and/or the vertical direction Z. Movements along the vertical direction Z can relate to vibrations due to friction on the ground when the base 3 is displaced.

The sensor 6 may measure an acceleration of the module 2 lower than 20 $m/s^2$ (meter per second squared).

According to another embodiment, the sensor 6 is adapted to measure a pressure applied on the module 2. Such pressure can correspond to the liquid force that is exerted on the face 4*b* of the wall 4.

The sensor 6 can measure the pressure relative to the atmospheric pressure. To this end, the sensor 6 can for instance be a differential pressure sensor, or comprise a secondary sensor to measure atmospheric pressure.

The sensor 6 may measure a pressure on the module 2 that is lower than 10 kPa (kiloPascal) relative to the atmospheric pressure.

Figure 2:
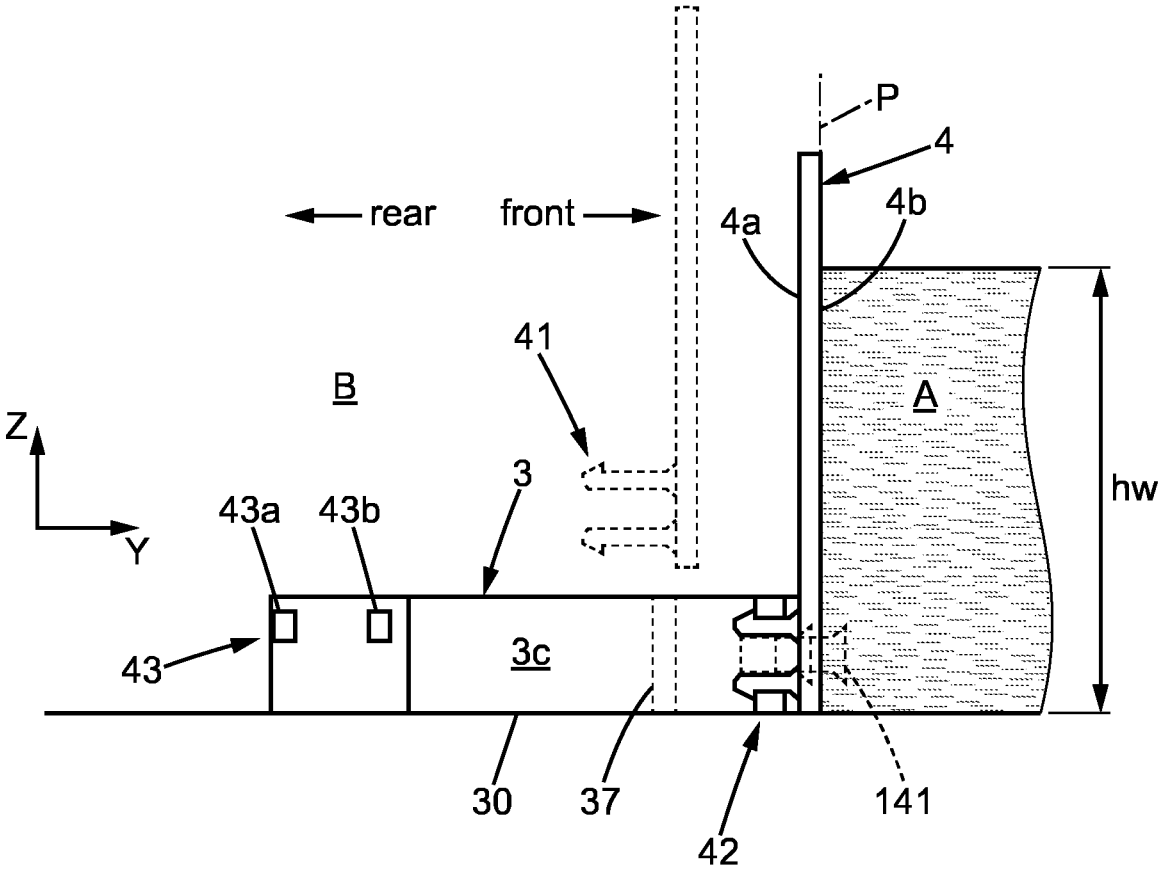
FIG. 2 shows a side elevation section view of a module of the present disclosure.

According to another embodiment, the sensor 6 is adapted to measure a liquid level hw according to the vertical direction Z (cf FIG. 2).

Several methods are possible to this end.

For instance, the sensor 6 can measure a pressure, as described above, to obtain information on the liquid level hw. The relationship between liquid level hw and pressure P depends on the liquid volume weight. This volume weight can be approximate by water volume weight. To obtain a one-millimeter resolution, it is thus necessary to get a pressure resolution of at least 10 Pa (pascal).

The relationship between liquid level hw and pressure depends on the liquid volume height.

There may be provided two pressure sensors 6A, 6B, one at the bottom portion of the module and another one at a predefined height along Z. The distance between the sensors being known, the pressure difference denotes generally the presence of liquid/water, and denotes precisely the respective apportionment of air and liquid in the space between the two sensors.

In one embodiment, the module 2 may comprise geolocation means. The geolocation means can be a GPS sensor and receiver. Alternatively, the geolocation means can be a Galileo or a Glonass receiver.

As for another example, the sensor 6 can be a light detection and ranging (Lidar) module or a radar module. Distance to the liquid level may be computed by comparing the time of flight (TOF) or the phases of emission and reception between the emission and reception of a physical signal by the sensor 6.

As for another example, the sensor 6 can be a capacitive sensor adapted to measure the dielectric permittivity between liquid and air. To this end, the sensor 6 comprises a plurality of electrodes disposed next to the other in the vicinity of the liquid surface (not illustrated). An electric circuit can measure the resulting capacity between each electrode pair.

According to another embodiment, the sensor 6 is adapted to measure flow velocity of the liquid alongside the protective barrier 1. Here velocity concerns longitudinal velocity of liquid along direction X.

The examples given above for the sensors 6 are exemplary and non-limitative. Also, the protective barrier 1 can comprise one or several sensors 6 adapted to measure the same or different types of information.

Figure 12:
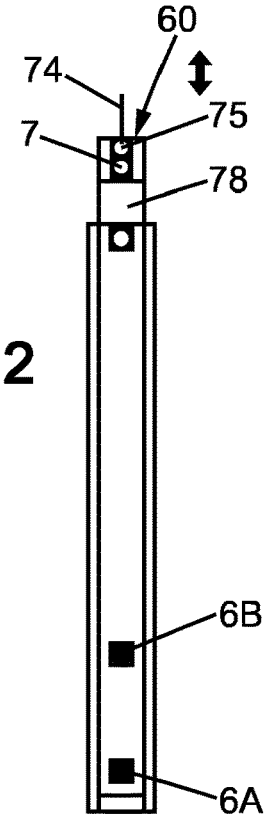
FIG. 12 shows a view of an example of sensor module.

As illustrated on FIGS. 9 and 12, sensors 6 can be mounted, more preferably attached, to the already mentioned sensor module 60 which is in turn inserted into the lateral attachment device 5. The sensors can be glued, welded, or clipped onto the sensor module 60. In the case one sensor exhibits a malfunction, maintenance can be done by replacing only the faulty sensor or by replacing the complete sensor module which will be serviced off-line later, without disassembling the protective barrier even though it is in function.

Float/Linkage/Filling

As for another example, the module 2 can comprise a float adapted to move in the vertical direction Z relative to the module 2, by remaining at the liquid surface. There is provided an intake port which is a passage placing in communication the interior area of the box with the external area of the box. The intake port 39,49 is arranged to let liquid into the box.

The weight of the liquid staying in the box participates to the anchoring effect, along with the rugged lower face of the box and, if placed, the anchoring rods into the anchoring wells (see further below).

Cooperating with the intake port, there is provided an intake valve 19 that can selectively open the port or close the port. Intake valve has a plunger 18 and a circular body 16, configured to come in contact with a valve seat. Valve seat can comprise a soft flat ring 17 abutting on an annular support 17*a*.

In one embodiment of the present disclosure, the valve is selectively controlled by a float 8 arranged in the interior space of the box, via a control mechanism.

Said control mechanism is formed as a cam 14 and a linkage 9.

Linkage 9 has a first end 91 attached to the float, preferably a journal attachment (axis A8). The attachment of the first end of the linkage 9 at axis A8 lies close to the center of gravity of the float 8.

The float is manufactured in a material having a density lower than 1, so that good buoyancy is ensured for the float 8; for example an expanded foam of polyurethane.

Figure 5A:
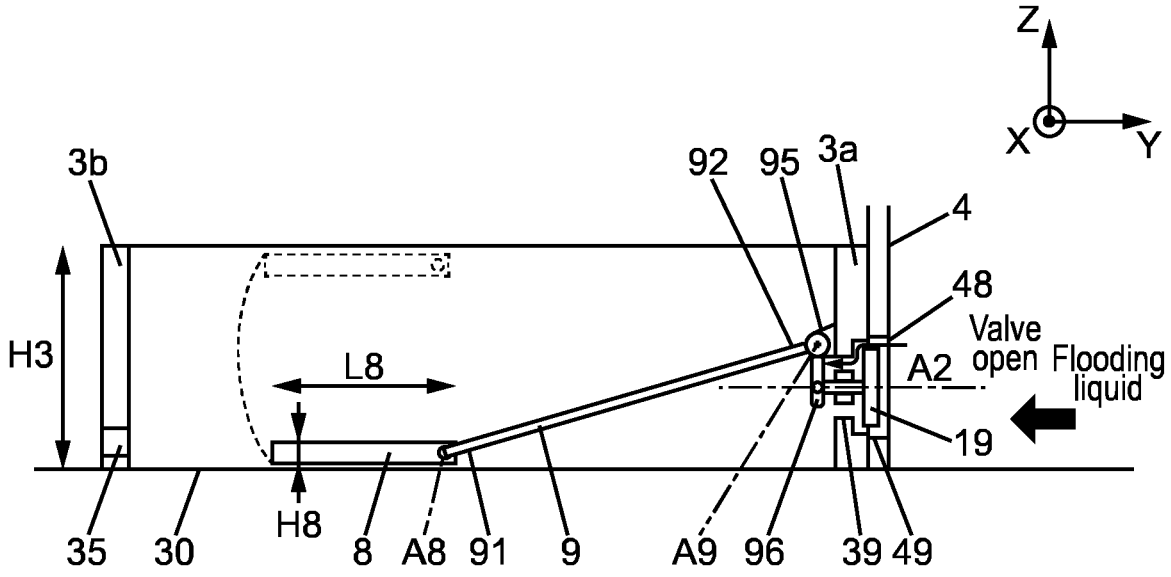
FIGS. 5A and 5B show diagrammatically side section views of the module, respectively in an empty configuration, and after filling with flooding liquid.
Figure 5B:
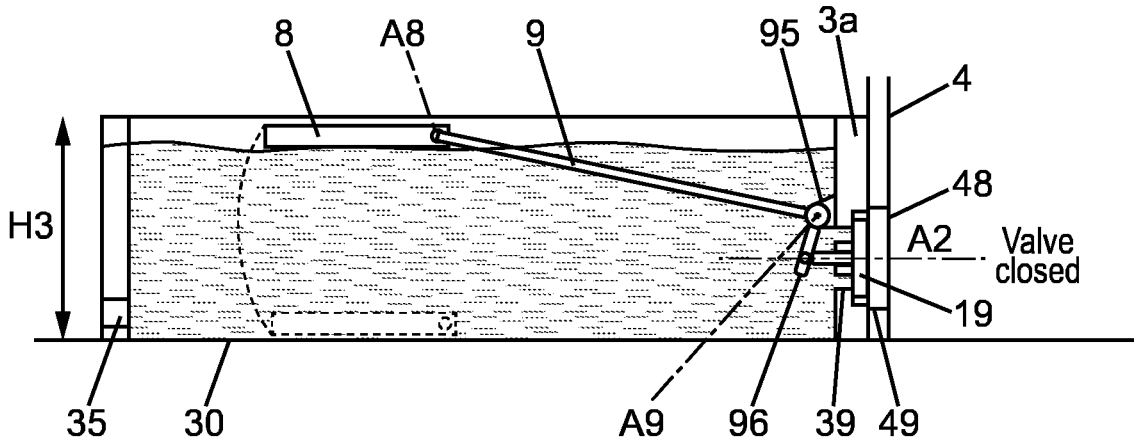
Figure 6:
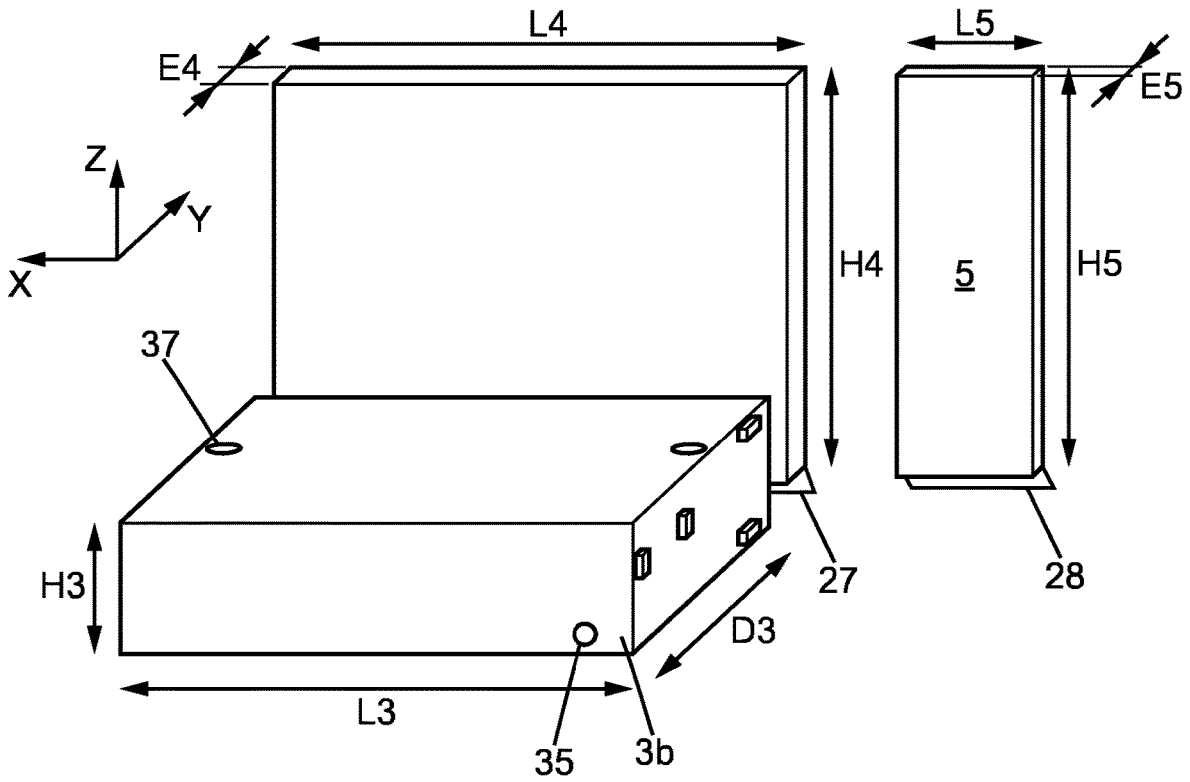
FIG. 6 shows diagrammatically the module in three components.
Figure 7:
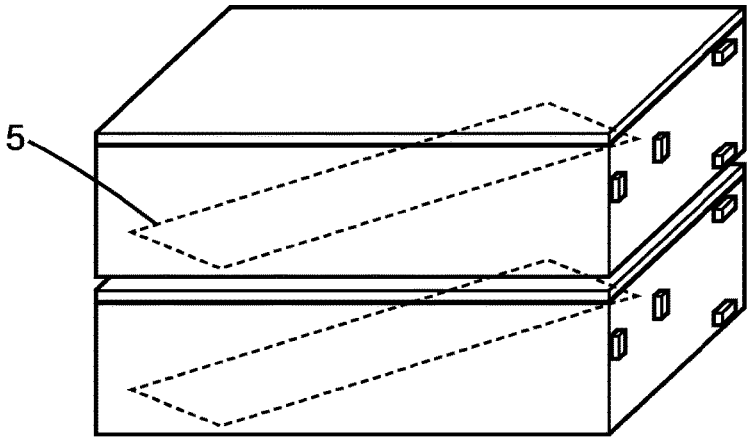
FIG. 7 shows diagrammatically two modules arranged one atop another, in a stowing configuration, for optimizing storage volume.

As illustrated in FIGS. 5A and 5B, a second end 92 of the linkage 9 is rotatably attached to the front wall 3*a* of the box via a bearing denoted 95. A further part 96 rigid with the linkage 9 acts as a cam pushing or pulling on the end of the piston of the intake valve 19. This journal mount at the bearing 95 is about axis A9, parallel to X.

Figure 16:
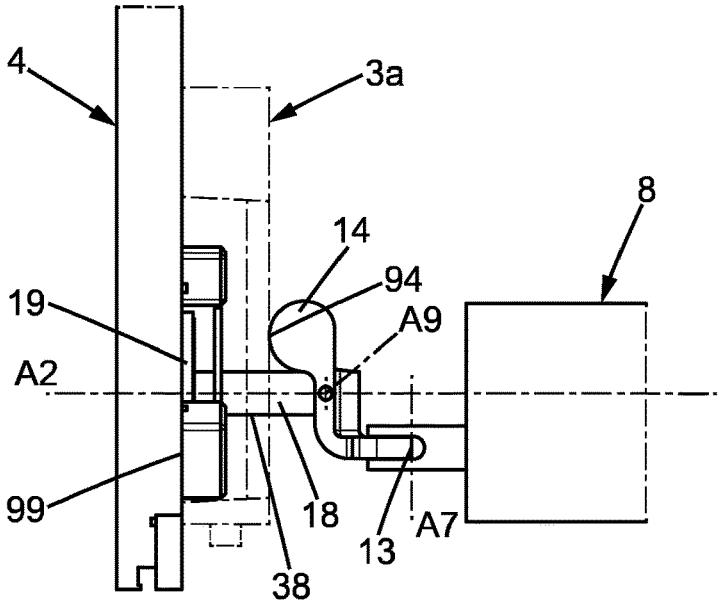
FIG. 16 illustrates a detail of the control of the float/linkage system.
Figure 17:
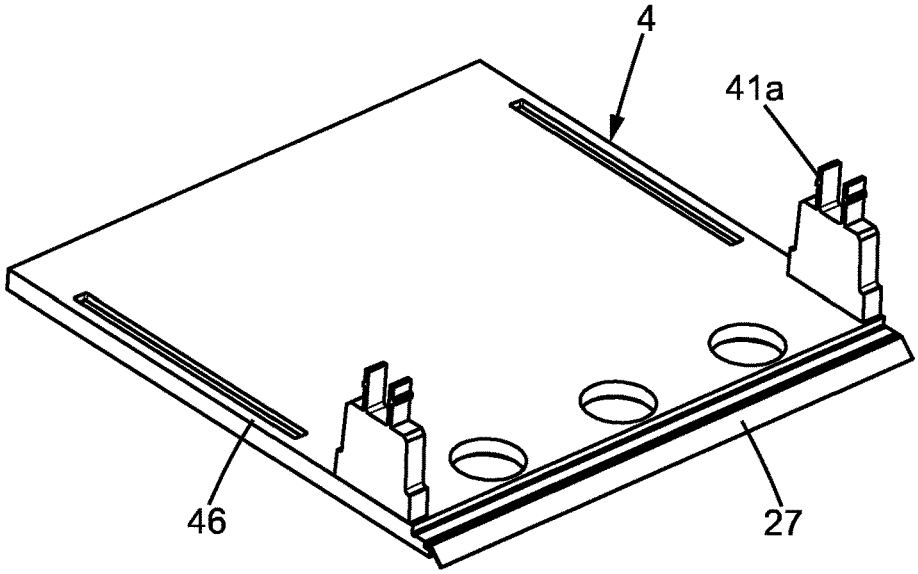
FIG. 17 illustrates the retaining plate alone.
Figure 18:
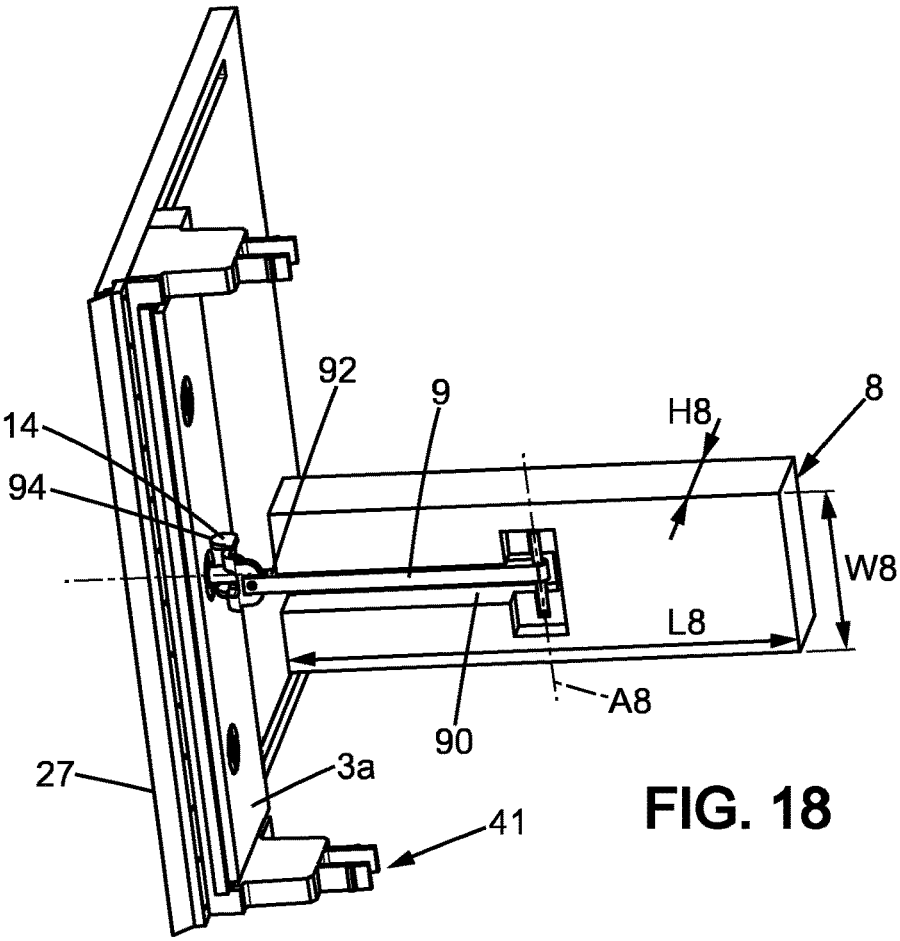
FIG. 18 illustrates an example of float/linkage system viewed from below.
Figure 19:
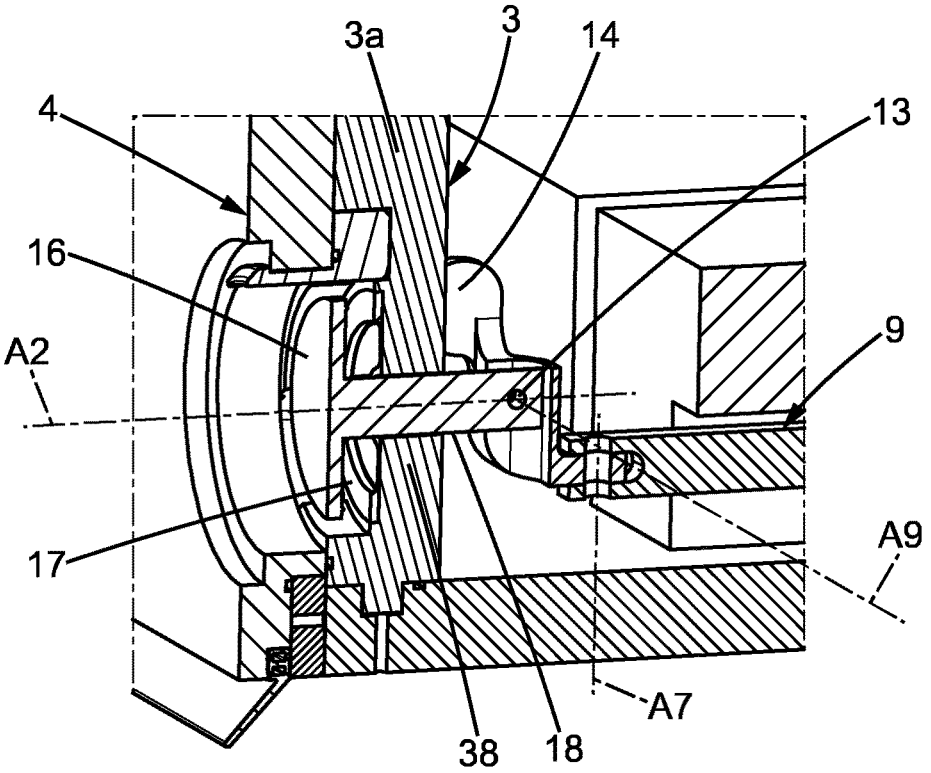
FIG. 19 illustrates a detailed sectional view of the intake valve.
Figure 20:
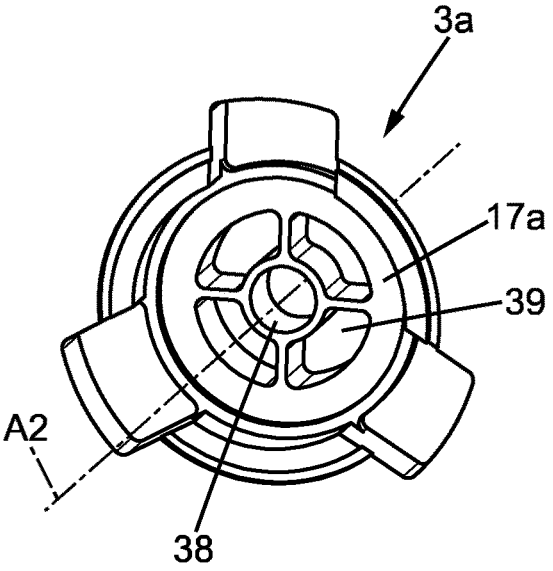
FIG. 20 illustrates a detailed view of an orifice in the retaining plate at the intake port area.

As illustrated in FIGS. 16, 18, 19, the linkage 9 has a second end 92 to which the cam 14 is attached. The second end 92 of the linkage is rotatably mounted on the plunger 18 of the intake valve 19, at axis A9. Further, optionally as shown, the second end 92 of the linkage 9 is rotatably mounted with respect to cam 14 and intake valve 19 at axis A7 via a pin 13. Plunger 18 is slidably received along axis A2 in a cylindrical bearing 38 arranged in the front wall 3*a* of the box 3.

According to one embodiment the float can be provided at the bottom portion with a recess 90 for protecting/guiding the linkage 9.

In the illustrated example, there are provided two grooves 46 at the side 4*a* of the wall 4, and there are provided corresponding protrusions 36 at the top end of the lateral walls 3*c*, 3*d* of the box 3.

There may be provided filter 48 to prevent ingress of solid object into the intake valve and intake port.

Figure 4:
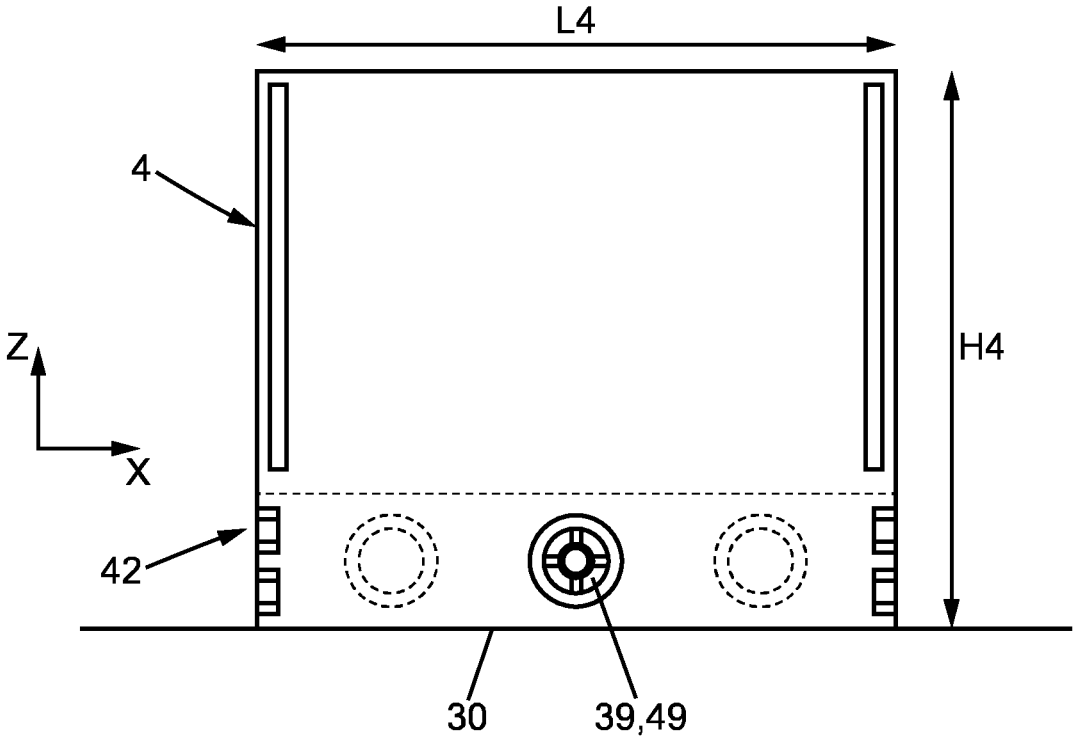
FIG. 4 shows a front elevation view of a module of the present disclosure.
Figure 13:
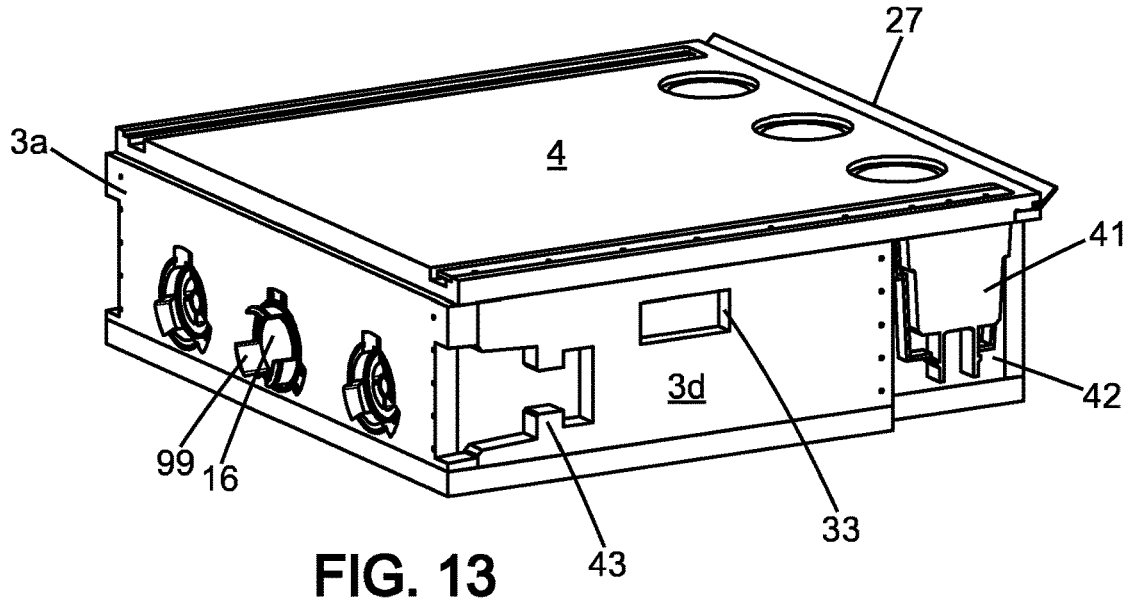
FIGS. 13 to 15 illustrate a variant embodiment.
Figure 15:
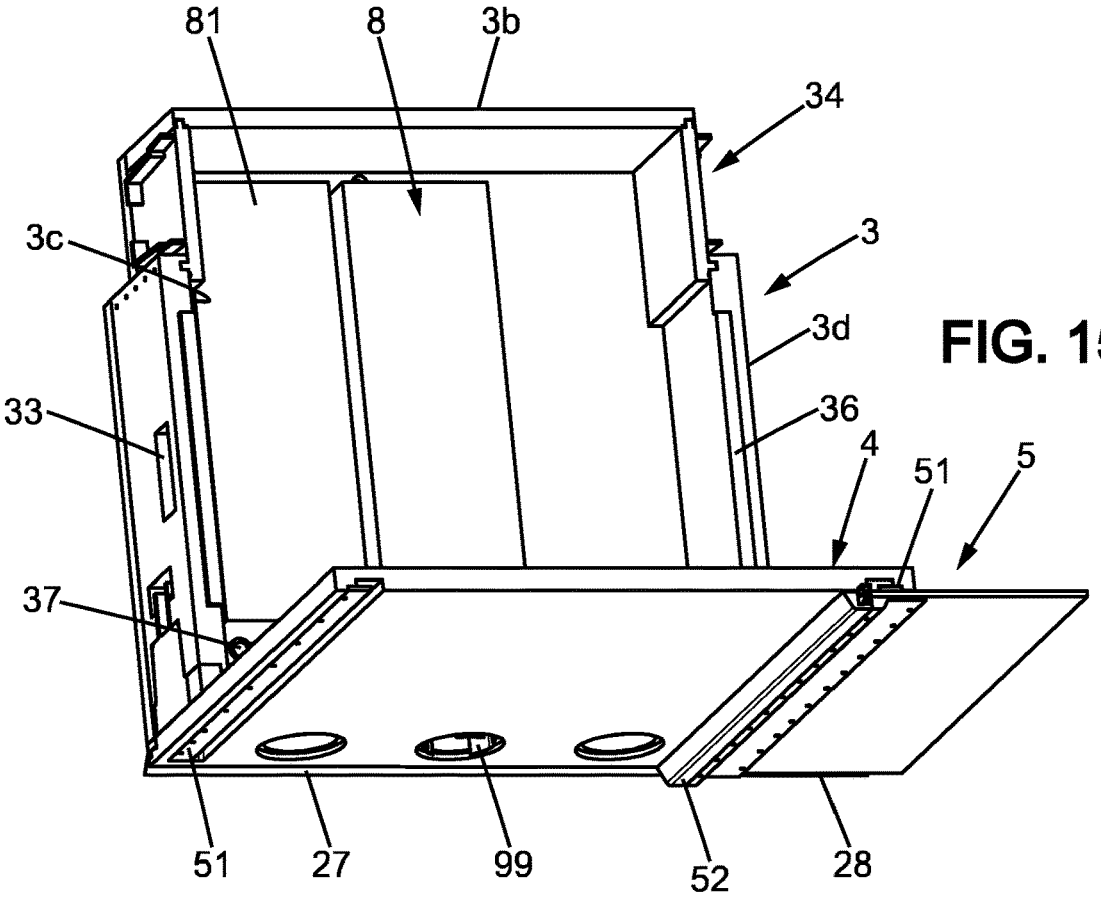

One or more additional intake valve can be provided, for example up to three intake valve as illustrated at FIGS. 4,13,15, with one or more additional float(s) 81 to control such additional intake valve(s).

Control Unit & Communication

Figure 8:
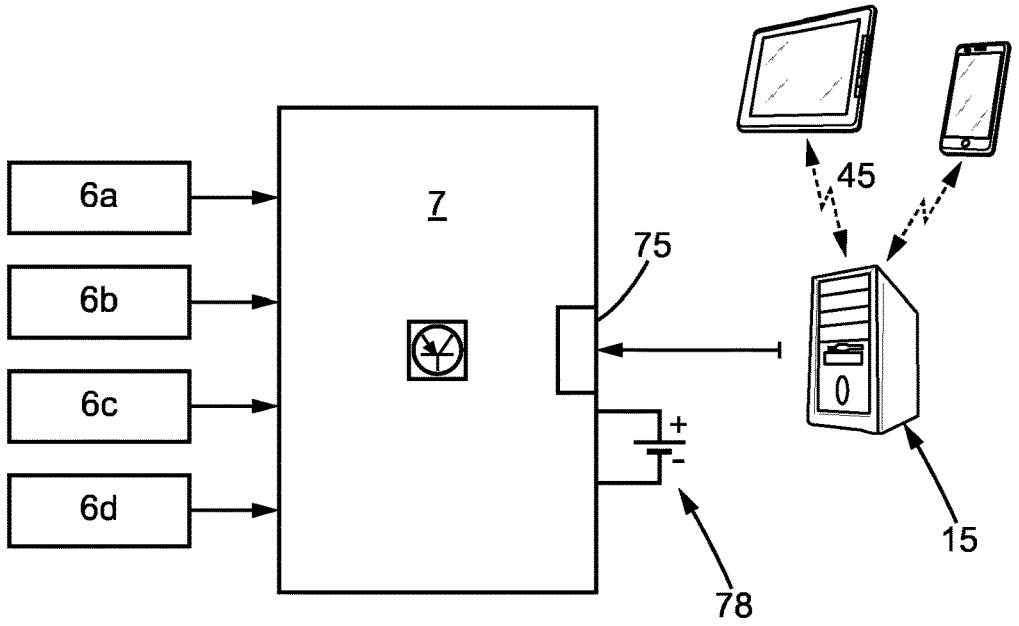
FIG. 8 shows a functional block diagram a schematic illustrating view of a system to obtain information on the protective barrier.

FIG. 8 describes a schematic view of a system comprising various sensors 6A, 6B, 6C, 6D.

The sensors 6 are adapted to send the information measured to a control unit 7. The control unit 7 is adapted to interface with the sensors 6 and to store the information that has been previously measured.

The control unit 7 is for example a microchip, microprocessor, and/or electronic memory, where appropriate mounted and interconnected on a flexible or rigid printed circuit board and operatively connected to the sensors 6 via wired connections. The control unit 7 is adapted to be mounted on the lateral attachment device 5, for example as described above for the sensors 6. The control unit 7 is a "local" control unit by contrast to any remotely arranged control entity or computer.

A communication coupler 75 adapted to send the information, once treated by the control unit 7, to an external device, such as a remote server 15. The communication coupler 75 is adapted to be mounted on the lateral attachment device 5, for example as described above for the sensors 6. There may be provided, additionally to the communication coupler, a communication antenna 74.

Communication link 45 to remote server can be made thanks to any network providing enough bandwidth, low-priced, and having a satisfactory communication range while consuming a small quantity of energy. This way, the system can be autonomous without having to be wired to a remote energy source. The communication coupler 75 may advantageously be a wireless communication coupler 75, for example a module implementing a protocol such as Sigfox, LoRa, Bluetooth Mesh, Narrow Band IoT (NB-IoT) or LTE-M.

To provide energy to the sensors 6 and the control unit 7, the system can further comprise a disposable or non-disposable battery 78. The battery 78 may be capable of supplying power to the sensors 6, the control unit 7, and where appropriate a memory and the communication module. The battery 78 is preferably adapted to supply power for several hours without recharging. The battery 78 is adapted to be mounted on the lateral attachment device 5, for example as described above for the sensors 6.

In view of the above, the sensor module 60 comprises one or more sensors 6, a local control unit 7, the battery 78, and the coupler 75, as illustrated at FIG. 12.

The sensor module 60 is advantageously mounted the lateral attachment device 5. This way, in the event that the system needs to be replaced, only the lateral attachment device 5 can be removed from the protective barrier 1 and substituted with other lateral attachment devices 5 comprising some other types of sensors 6.

The protective barrier 1 is therefore easily adaptable without imposing particular constraints and without having to disassemble/assemble the whole protective barrier 1 to set up other types of sensors.

However, this embodiment is non-limitative and the sensor module 60 could be located on any other part of a module 2, such as the base 3 or the wall 4 of the module 2.

Relief Valve

Figure 10:
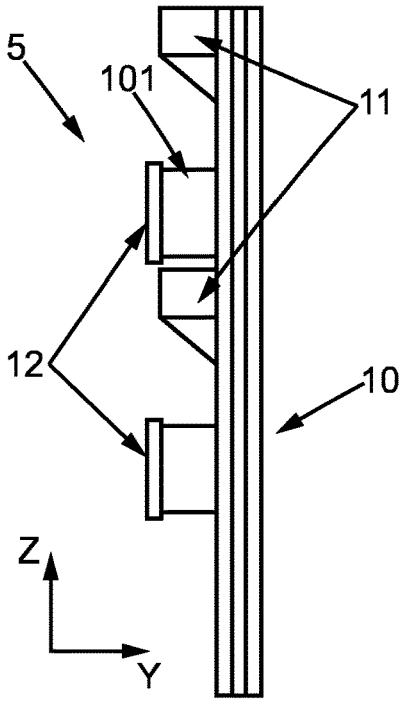
FIG. 10 shows a side view of an attachment device comprising two relief valves.
Figure 11:
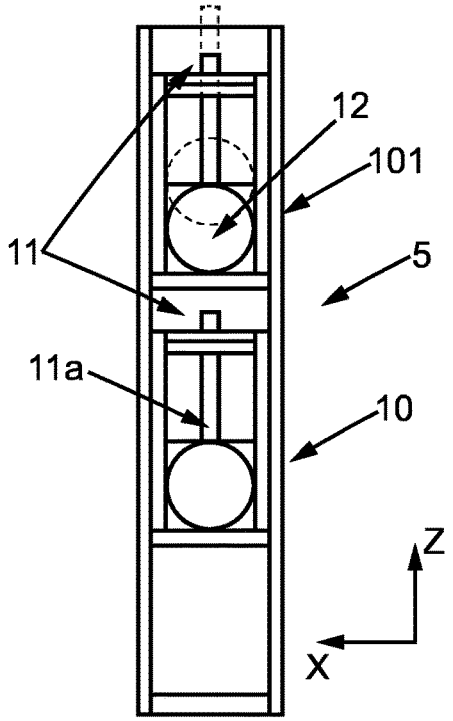
FIG. 11 shows a front view of the attachment device of FIG. 10 comprising two relief valves.

As illustrated on FIG. 9, FIG. 10 and FIG. 11, the module 2 also comprises a relief valve 10. The valve 10 is adapted to allow discharge or dump of liquid from the front side to the rear side of the protective barrier 1, notably in specific cases when the integrity of the protective barrier 1 is at stake/can be jeopardized.

The valve 10 can be located, more preferably attached, to the lateral attachment device 5. Such discharge valve 10 can be particularly useful to deal with liquid overflow, when liquid is in excess on the front side of the protective barrier 1.

Alternatively, the valve 10 can be located in the wall 4 of the module 2.

It can be also useful when the protective barrier 1 may break because of a too high pressure exerted by the liquid. Using the valve 10 thus permits a controlled discharge of the liquid instead of a sudden flood in the protected zone B due to an unexpected burst of the protective barrier 1.

The valve 10 can be of any type such as a guillotine valve, a poppet valve, of the membrane type, an iris valve.

As illustrated more particularly on FIG. 9 and FIG. 11, the lateral attachment device 5 can comprise two relief valves 10,101 one above the other in the vertical direction Z.

Each valve 10 can be controlled thanks to a simple or double acting motor 11,11*a* so that the opening 12 of the valve may be actuated alternately in an open or a closed position to let, or not, liquid to flow through the valve 10. In the closed position, a closing element, such as a cover, can be placed in a liquid-tight manner in front of the opening 12.

The present disclosure also relates to a method for controlling a protective barrier 1, advantageously in real time.

In a first step, information on the protective barrier 1 or on the retained liquid are acquired.

In a second step, this information is processed by the unit control 7 or by a remote server.

In a third step, relief valves 10 can be actuated based on the information acquired, in order to discharge some liquid from one side to another of the protective barrier.

More particularly, if the information shows that there is a risk that the protective barrier may not resist (because the liquid pressure exerted by the liquid level is too high, so that the protective barrier may break), the valves 10 are actuated to be in the open position.

In one particular embodiment, the remote computer 15 is coupled to more than 50 sensors, the length of the protective barrier can be up to more than 500 meters.

The method for controlling a protective barrier 1, comprises, advantageously in real time, at least the steps of:

- acquiring information on the protective barrier or on the retained liquid with one or more sensor 6,
- processing the information to determine whether the protective barrier may break due to the liquid pressure, or if there is a need to discharge some liquid for balancing the downstream flow,
- make a decision to open one or more relief valves,
- make a decision to close one or more relief valves.

It should be understood that the above-mentioned decision can be taken by a human individual in charge of managing the behaviour of the protective barrier, or alternatively or additionally the decision can be taken by a computer following predefined rules.

According to one aspect, each module comprises geolocating means, where the current geolocation of each module is sent to the remote computer, and the method further comprises:

- send the current geolocation of each module to a remote computer, together with the information about the liquid body level and the acceleration data,
- aggregate the geolocation of each module with the information about the liquid body level and the acceleration data,
- build therefrom at the remote computer a comprehensive image of the current state of the protective barrier.

Thanks to such geo-located "picture", the relevance of the decision can be enhanced, and the place(s) where the relief valve should be open can be more effective, for safeguarding the protective barrier and/or for managing liquid flow downstream and along the barrier.

According to one aspect, the actuation signal to open the relief valve is issued whenever a height of the liquid body exceeds a first predetermined threshold (HL), or an acceleration experienced at the module exceeds a second predetermined threshold (AL). This represents an example of stress limit that can be withstood by the protective barrier.

Wall/Base Coupling

Figure 3A:
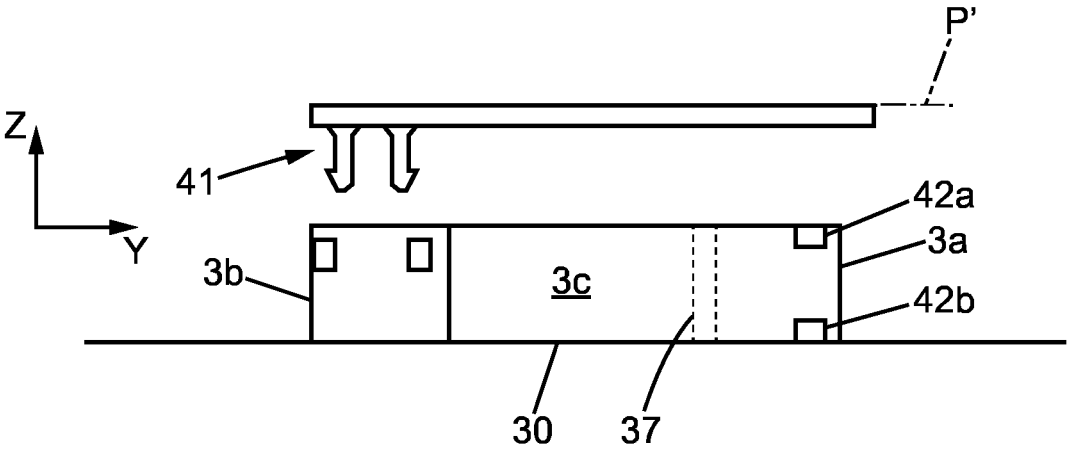
FIGS. 3A and 3B show diagrammatically side section views of the module, respectively before assembly in a stowing configuration, and after assembly in a stowing configuration.
Figure 3B:
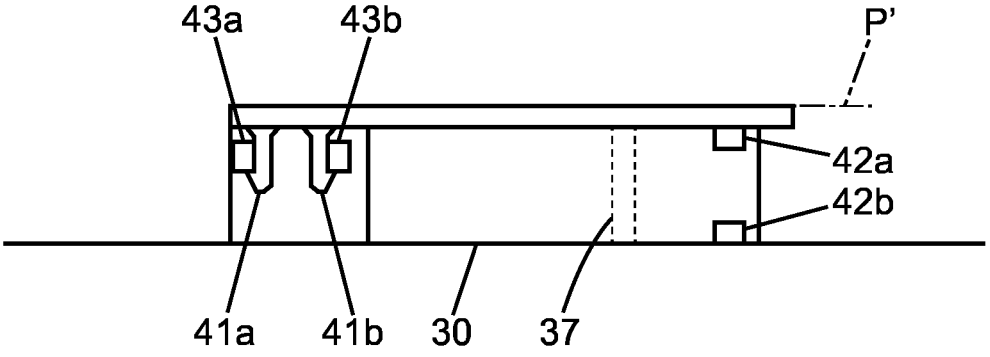

According to one aspect illustrated in particular FIGS. 2, 3A, 3B, there are provided two main configurations for the respective assembly of the retention plate with regard to the box. Firstly there is provided a working position for the retention plate, wherein the retention plate is configured to be removably attached to the box at a front portion of the box, so to retain the liquid body on the front area of the protective barrier.

As a result, the reference plane P of the retention plate is arranged substantially vertically and adapted to retain the liquid on a front side A of the protective barrier.

Secondly there is provided a stowed position, in which the reference plane of the retention plate is arranged substantially horizontally (denoted P'), and in which the retention plate is removably fixed/attached to the box at a back/rear portion.

Figure 14:
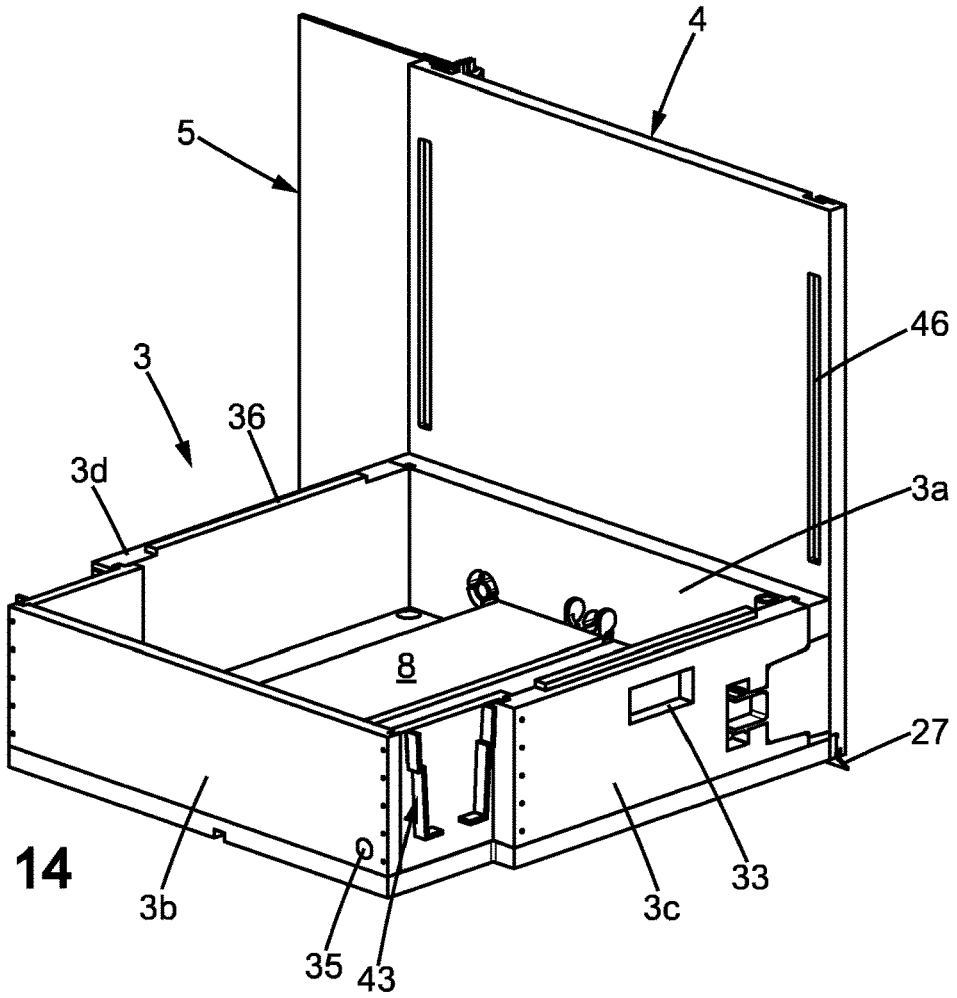

More precisely as illustrated at FIG. 14, there is provided on the retention plate a left snap-fit protrusion and a right snap-fit protrusion 41,41*a*,41*b* each configured to be received respectively in a least a left retention recess 42, and a least a right retention recess 43 arranged in the box 3.

Left and right retention recess denoted 42, 42*a*, 42*b* are used for the working position whereas by contrast left and right retention recess denoted 43, 43*a*, 43*b* are used for the stowing position.

Each of the left and right snap-fit protrusion is formed as at least an elastic tongue 41*a*.

For optimizing respective sizes versus the stowing capacity, it may be considered that the height H4 of the retention plate is substantially equal to the transverse length D3 of the box. Also for the same purpose it may be considered that the width L4 of the retention plate is substantially equal to the width L3 of the box.

We note that the rear portion of the box is beveled at the rear portion 34 of the box. This is beneficial when the barrier exhibits and overall curvature with a center of curvature located in the rear side (dry zone B).

According to one embodiment there are provided in the box two vertical wells 37 configured to receive anchoring rods 73. The circumstantial operation of the barrier may require that some or all the modules may be anchored mechanically to the ground. In such case an operator can insert an anchoring rod 73 into one of the vertical well 37 and hits the anchoring rod 73 down into the ground. The interior area of the well 37 is liquid-tight with respect to the rest of the box.

According to a further embodiment, the intake valve 19, instead of being controlled by a float arrangement, is controlled by an actuator which can be controlled remotely from the remote server. The actuator can be servo motor, and electromagnetic valve, or any device that can selectively open or close the intake valve.

Thanks to this provision, it is contemplated to control the filling of the boxes 3 of each module 2. In addition, with help of the liquid level sensor 6A 6B, it is possible for the local control unit 7 or the remote server 15 to know the level of liquid filling with in each box. Thereby, in conjunction with a data coming from the sensors 6, the one or more computer (7 and/or 15) can cause the intake valve to open, or cause the intake valve to close. The decision can be taken by the remote server 15 in view of the overall behaviour of the protective barrier, and also in view of the anchoring needs.

The invention claimed is:

1. A module for implementing a protective barrier against liquid runoff and/or flooding, the module comprising:

a base adapted to anchor the module to the ground, the base being a liquid-filled holding tank, a wall forming a retention member and extending substantially in a vertical direction from the base, the wall being adapted to retain a liquid body on a front area located at a front side of the protective barrier, at least one sensor adapted to acquire at least one information about the module or about the liquid body;

at least one relief valve, the relief valve being movable between a closed state and an open state, wherein in the open state the relief valve lets liquid flow from the front area to a rear area, wherein the relief valve is adapted to be actuated from the closed state to the open state according to the at least one information acquired and provided by the sensor.

2. The module according to claim 1, further comprising an attachment device adapted to connect the module to other modules to implement the protective barrier.

3. The module according to claim 2, wherein the sensor and the relief valve are mounted on the attachment device.

4. The module according to claim 1, wherein the sensor senses a height of the liquid body.

5. The module according to claim 1, wherein the sensor senses an acceleration denoting a movement of the module.

6. The module according to claim 1, wherein the module comprises a GPS receiver, a Galileo receiver, or a GLONASS receiver.

7. The module according to claim 1, where there the at least one relief valve comprises at least a first and a second relief valve, the second relief valve being arranged above the first relief valve.

8. A system comprising:

a plurality of the modules according to claim 1; and one or more computers connected to the at least one sensor of one or more of the plurality of modules, the one or more computers being adapted to receive information from the at least one sensor and to output an actuation signal intended to open the relief valve of one or more of the plurality of modules.

9. The system according to claim 8, wherein the at least one sensor of each module is a plurality of sensors, each module comprises a local control unit, the local control unit being configured to collect various parameters from the plurality of sensors, and additionally the system comprises a remote server configured to receive data collected by the local control unit of each module.

10. The system according to claim 9, wherein data delivered by the plurality of sensors of each module is transmitted to the remote server via a low consumption wireless network.

11. The system according to claim 9, wherein the data delivered by the plurality of sensors of each module is transmitted to the remote server via a short range wireless network.

12. The system according to claim 9, wherein each module comprises a geolocating receiver, where a current geolocation of each module is identified by the geolocating receiver and sent to the remote server, and the remote server is configured to aggregate the geolocation of each module with information about a liquid body level and acceleration data, and is configured to build therefrom a comprehensive image of the current state of the protective barrier.

13. A method for controlling a protective barrier comprising a plurality of the modules according to claim 1, advantageously in real time comprising at least the steps of:

acquire information on the protective barrier or on a retained liquid with the sensor;

process the information to determine whether the protective barrier may break due to a liquid pressure, make a decision to open the at least one relief valve of the protective barrier, make a decision to close one or more of the at least one relief valves of the protective barrier.

14. The method according to claim 13, wherein each module comprises a geolocating receiver, where a current geolocation of each module is identified by the geolocating receiver of the module and sent to a remote server, and the method further comprises:

send a current geolocation of each module to the remote server, together with information about a liquid body level and acceleration data, aggregate the geolocation of each module with the information about the liquid body level and the acceleration data, and build therefrom at the remote server a comprehensive image of the current state of the protective barrier.

15. The method according to claim 13, wherein an actuation signal to open the at least one relief valve is issued whenever a height of the liquid body exceeds a first predetermined threshold, or whenever an acceleration experienced at the module exceeds a second predetermined threshold.

16. The module according to claim 1, wherein each valve is controlled via a motor.

* * * * *